US006175334B1

(12) United States Patent
Vannatta et al.

(10) Patent No.: US 6,175,334 B1
(45) Date of Patent: Jan. 16, 2001

(54) DIFFERENCE DRIVE DIVERSITY ANTENNA STRUCTURE AND METHOD

(75) Inventors: Louis Jay Vannatta, Crystal Lake; Hugh Kennedy Smith, Palatine; James P. Phillips; David Ryan Haub, both of Lake in the Hills, all of IL (US)

(73) Assignee: Motorola, Inc., Schaumburg, IL (US)

( * ) Notice: Under 35 U.S.C. 154(b), the term of this patent shall be extended for 0 days.

(21) Appl. No.: 09/286,823

(22) Filed: Apr. 6, 1999

Related U.S. Application Data

(63) Continuation of application No. 08/853,772, filed on May 9, 1997, now Pat. No. 5,977,916.

(51) Int. Cl.[7] ..... H01Q 1/24

(52) U.S. Cl. ..... 343/702; 455/273; 455/89; 455/90

(58) Field of Search ..... 343/770, 725, 343/702, 767; 455/575, 90

(56) References Cited

U.S. PATENT DOCUMENTS

| | | | | |
|---|---|---|---|---|
| 3,631,500 | * | 12/1971 | Itoh | 343/725 |
| 4,575,725 | | 3/1986 | Tresselt | 343/700 MS |
| 4,613,868 | | 9/1986 | Weiss | 343/700 MS |
| 5,038,151 | | 8/1991 | Kaminski | 343/727 |
| 5,138,328 | | 8/1992 | Zibrik et al. | 343/702 |
| 5,274,388 | | 12/1993 | Ishizaki et al. | 343/725 |
| 5,463,406 | | 10/1995 | Vannatta et al. | 343/725 |
| 5,606,733 | | 2/1997 | Kanayama et al. | 455/273 |
| 5,760,745 | * | 6/1998 | Endo et al. | 343/702 |
| 5,764,190 | * | 6/1998 | Murch et al. | 343/702 |

FOREIGN PATENT DOCUMENTS

| | | |
|---|---|---|
| 0 036 139 A2 | 9/1981 | (EP) . |
| 0 749 216 A1 | 12/1996 | (EP) . |
| WO 85/02719 | 6/1985 | (WO) . |
| WO 91/02386 | 2/1991 | (WO) . |

OTHER PUBLICATIONS

Diversity Antennas For Base and Mobile Stations in Land Mobile Communication Systems, by Yoshihide Yamada, Kenichi Kagoshima, and Kouichi Tsunikawa, IEICE Transactions, vol. E 74, No. 10, Oct. 1991.

* cited by examiner

*Primary Examiner*—Tan Ho
*Assistant Examiner*—James Clinger
(74) *Attorney, Agent, or Firm*—Sylvia Chen

(57) ABSTRACT

A difference drive diversity antenna structure (200) and method for a portable wireless communication device (230) aligns a first linear antenna (240) parallel to a major axis (245) of the communication device and drives dual radiators (252, 254) of a second antenna (250) at equal magnitudes but with a 180 degree phase difference. A difference drive diversity antenna structure implemented in a portable wireless communication device maintains significant decorrelation between the first antenna (240) and the second antenna (250) over the common frequency ranges of the dual radiators (252, 254). Also, antenna currents on the body of the communication device are minimized and the effects of a hand or body near the communication device are reduced.

18 Claims, 7 Drawing Sheets

— PRIOR ART —

DIFFERENCE DRIVE DIVERSITY ANTENNA STRUCTURE AND METHOD

CROSS REFERENCE TO RELATED APPLICATIONS

This application is a continuation of Ser. No. 08/853,772 filed May 9, 1997, now U.S. Pat. No. 5,977,916.

This application is related to application Ser. No. 08/854,197 entitled "Multi-Layered Compact Slot Antenna Structure and Method" by David R. Haub, Louis J. Vannatta, and Hugh K. Smith (Attorney Docket No. CE01551R) filed same date herewith, the specification of which is incorporated herein by reference. This application is also related to application Ser. No. 08/854,272 entitled "Multi-Band Slot antenna Structure and Method" by Louis J. Vannatta and Hugh K. Smith (Attorney Docket No. CE01548R) filed same date herewith, the specification of which is incorporated herein by reference.

This application is based on prior U.S. application Ser. No. 08/853,772, filed on May 9, 1997, which is hereby incorporated by reference, and priority thereto for common subject matter is hereby claimed.

FIELD OF THE INVENTION

This invention relates generally to antenna structures, and more particularly to producing a sufficiently high decorrelation between two antennas that are in close proximity such that the diversity reception performance is maintained.

BACKGROUND OF THE INVENTION

Portable wireless communication devices such as radiotelephones sometimes use one or more antennas to transmit and receive radio frequency signals. In a radiotelephone using two antennas, the second antenna should have comparable performance with respect to the first, or main, antenna and should also have sufficient decorrelation with respect to the first antenna so that the performance of the two antennas is not degraded when both antennas are operating. Antenna performance is a combination of many parameters. A sufficient operating frequency bandwidth, a high radiation efficiency, and a desirable radiation pattern characteristic, and a low correlation, are all desired components of antenna performance. Correlation is computed as the normalized covariance of the radiation patterns of the two antennas. Due to the dimensions and generally-accepted placement of a main antenna along the major axis of a device such as a hand-held radiotelephone, however, efficiency and decorrelation goals are extremely difficult to achieve.

FIG. 1 shows a prior art two-antenna structure implemented in a hand-held radiotelephone 130. A first antenna 140 is a retractable linear antenna. When the first antenna is fully-extended, as shown, the length of the first antenna is a quarter wavelength of the frequency of interest. Note that the first antenna 140 is aligned parallel to the major axis 145 of the radiotelephone 130 and has a vertical polarization with respect to the ground 190.

The radiotelephone 130 also has a microstrip patch antenna as a second antenna 150 attached to a printed circuit board inside the radiotelephone 130 and aligned parallel to a minor axis 155 of the radiotelephone 130 to send or receive signals having a horizontal polarization with respect to the ground 190. In isolation, the second antenna 150 may well produce horizontally polarized signals, but when the second antenna 150 is attached to the printed circuit board and in the proximity of the first antenna 140, the polarization of the second antenna 150 reorients along the major axis 145 of the radiotelephone 130. As the polarization of the second antenna reorients, the first antenna 140 and second antenna 150 become highly correlated and many of the advantages of the two-antenna structure are lost. Commonly, a prior art two-antenna structure implemented in a radiotelephone has a correlation factor of over 0.8 between the two antennas. Effective diversity operation requires a correlation factor of less than 0.6 between the two antennas.

The reorientation of the polarization of the signals from the second antenna 150 is due to various factors, including the fact that hand-held radiotelephones typically has major axis 145 and the minor axis 155 dimensions with an aspect ratio greater than 2:1 and that the major dimension of the radiotelephone is significant with respect to the wavelength of operation while the other dimensions of the radiotelephone are small with respect to this wavelength. Additionally, because the minor dimension of the radiotelephone is small with respect to the wavelength of interest, the second antenna 150 is easily perturbed and detuned, which creates susceptibility to effects of the hand or head of a user 110 on antenna efficiency.

Thus there is a need for a two-antenna structure that maintains decorrelation and efficiency between a first antenna aligned along a major axis of a portable wireless communication device and a second antenna.

DETAILED DESCRIPTION OF THE PREFERRED EMBODIMENTS

A difference drive diversity antenna structure and method for a portable wireless communication device aligns a first linear antenna parallel to a major axis of the communication device and drives dual radiators of a second antenna at equal magnitudes but with a 180 degree phase difference. A difference drive diversity antenna structure implemented in a portable wireless communication device maintains significant decorrelation between the first antenna and the second antenna over the common frequency ranges of the dual radiators. Also, antenna currents on the body of the communication device are minimized and the effects of a hand or body near the communication device are reduced.

Figure 1:
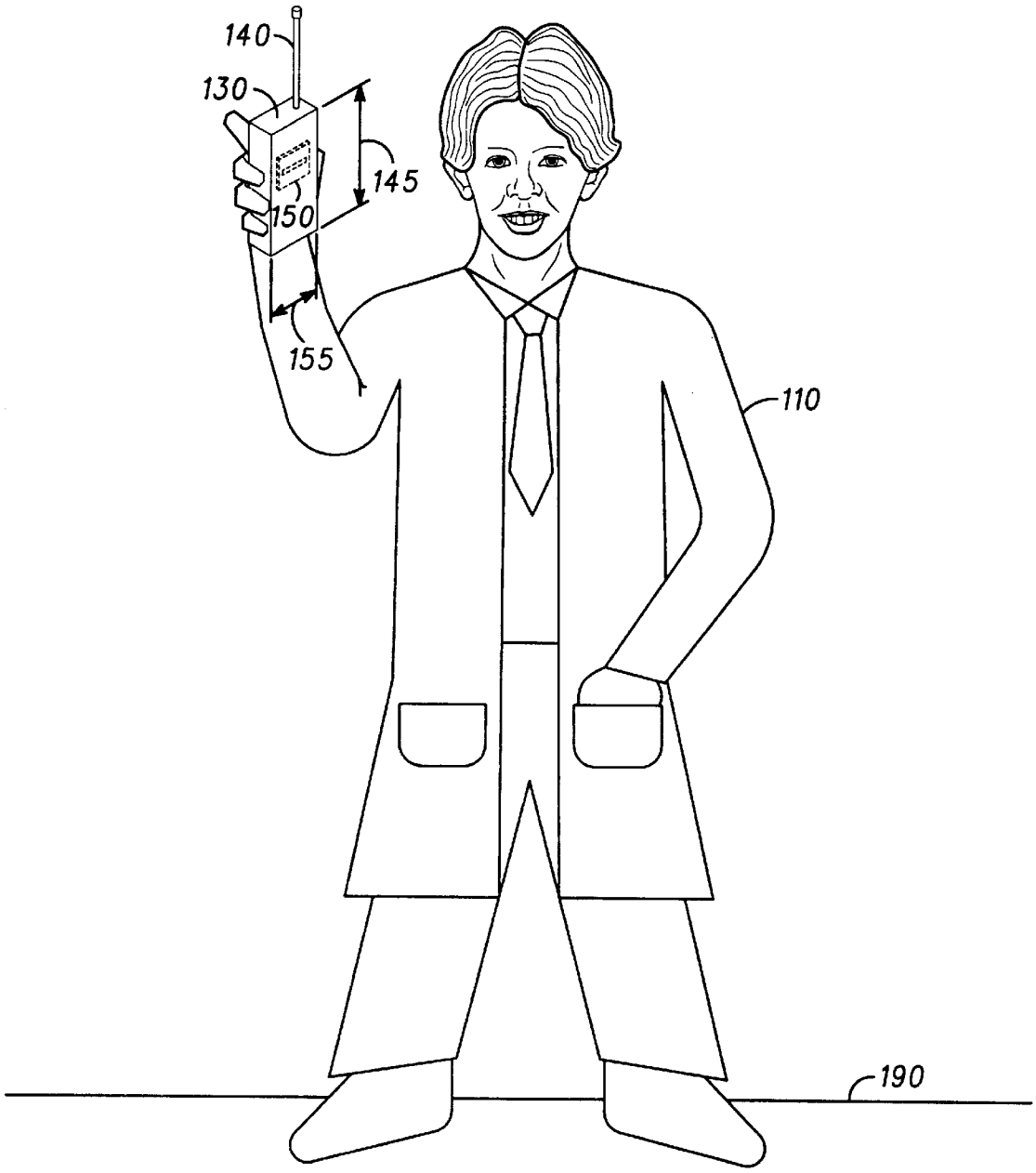
FIG. 1 shows a prior art two-antenna structure implemented in a radiotelephone.
Figure 2:
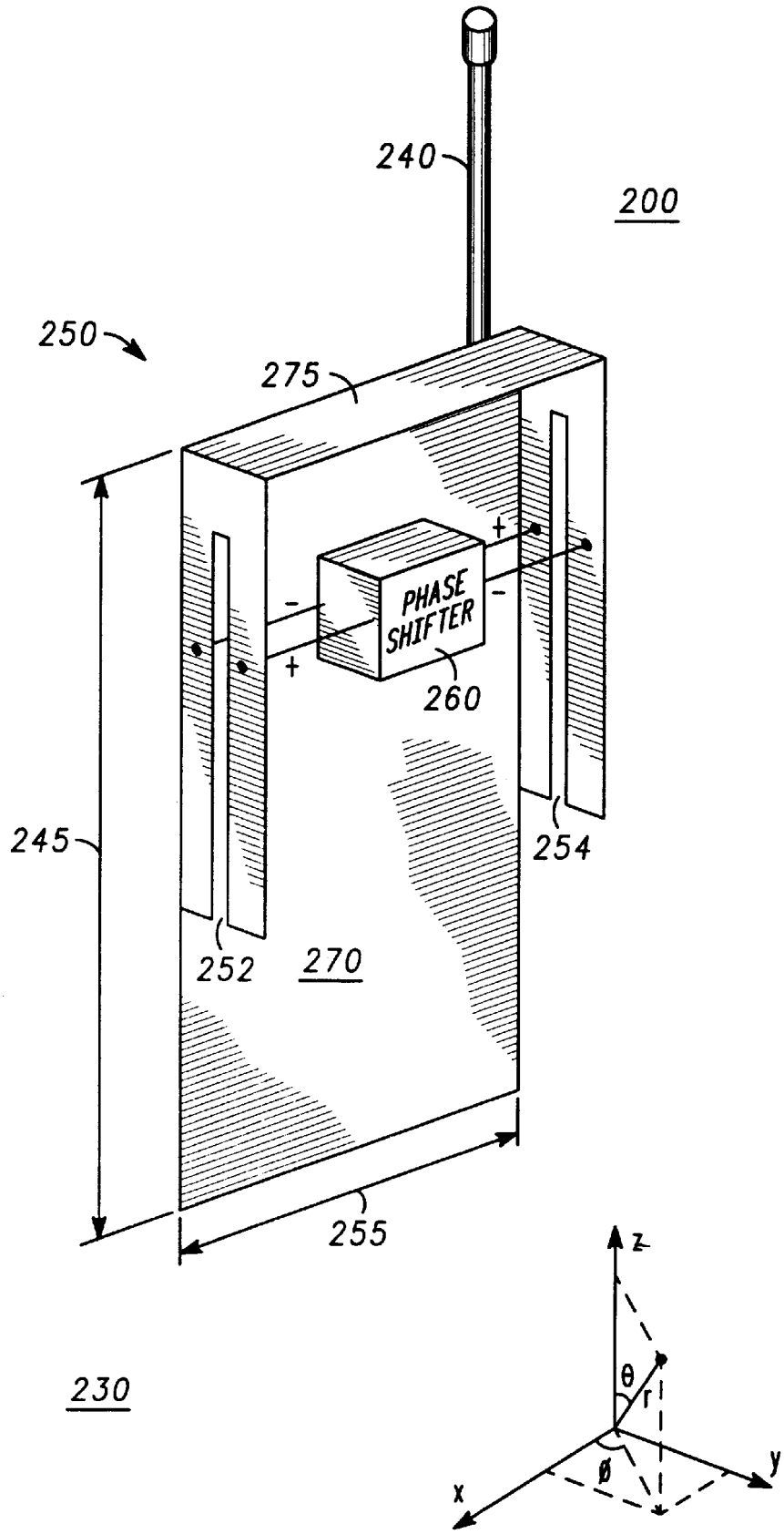
FIG. 2 shows a simplified diagram of a difference drive diversity antenna structure implemented according to a first preferred embodiment in a radiotelephone.

FIG. 2 shows a simplified diagram of a difference drive diversity antenna structure 200 implemented according to a first preferred embodiment in a radiotelephone 230. A first antenna 240, such as a retractable linear wire antenna, is aligned parallel to the major axis 245 of a radiotelephone 230. This axis will be considered the z-axis. When the first antenna 240 is fully-extended, as shown, the length of the antenna is a quarter wavelength of a frequency of interest. During operation, the first antenna 240 produces signals that are vertically polarized with respect to the major axis, which would lie in the xy-plane.

A second antenna 250 has dual radiators 252, 254 connected by a common leg 275. The common leg 275 is coupled to the circuit board 270 for grounding purposes. In this embodiment, each radiator is each a conventional quarter wavelength slot implemented in conductive surface that is also grounded to the circuit board 270. The first radiator 252 is aligned along one edge of a circuit board 270 of the radiotelephone 230 parallel to the major axis 245 and the second radiator 254 is aligned along an opposite edge of the circuit board 270. Although the radiators need not be placed at opposite edges of the circuit board 270, as the separation distance between the two radiators increases, the performance of the second antenna 250 increases.

The two radiator 252, 254 are drive 180 degrees out of phase but at the same magnitude using a single differential port for each radiator. A phase shifter 260, such as a balun or transmission line, is used to create the driving signals for each radiator 252, 254. At the frequency ranges that are common to the individual radiators 252, 254, differentially driving the two radiators 252, 254 of the second antenna 250 creates $E_\theta$ and $E_\phi$ components of electric field vectors in the xy-plane that are orthogonal to the $E_\theta$ components of the first antenna 240. The first antenna 240 produces predominantly $E_\theta$ components of electric field vectors so that there is virtually no correlation with the $E_\phi$ components of the second antenna 250 because $E_\theta$ and $E_\phi$ are orthogonal polarizations. All combinations of orthogonal polarizations are entirely and completely decorrelated so that they have zero covariance and therefore zero contribution to the correlation factor.

The only significant contribution to the correlation between the first antenna 240 and the second antenna 250 is the $E_\theta$ component of the radiation pattern of both antennas 240, 250 when they occur in common angular regions. The phenomena that minimize the correlation is best understood by examining the radiation patterns of the two antennas.

Figure 3:
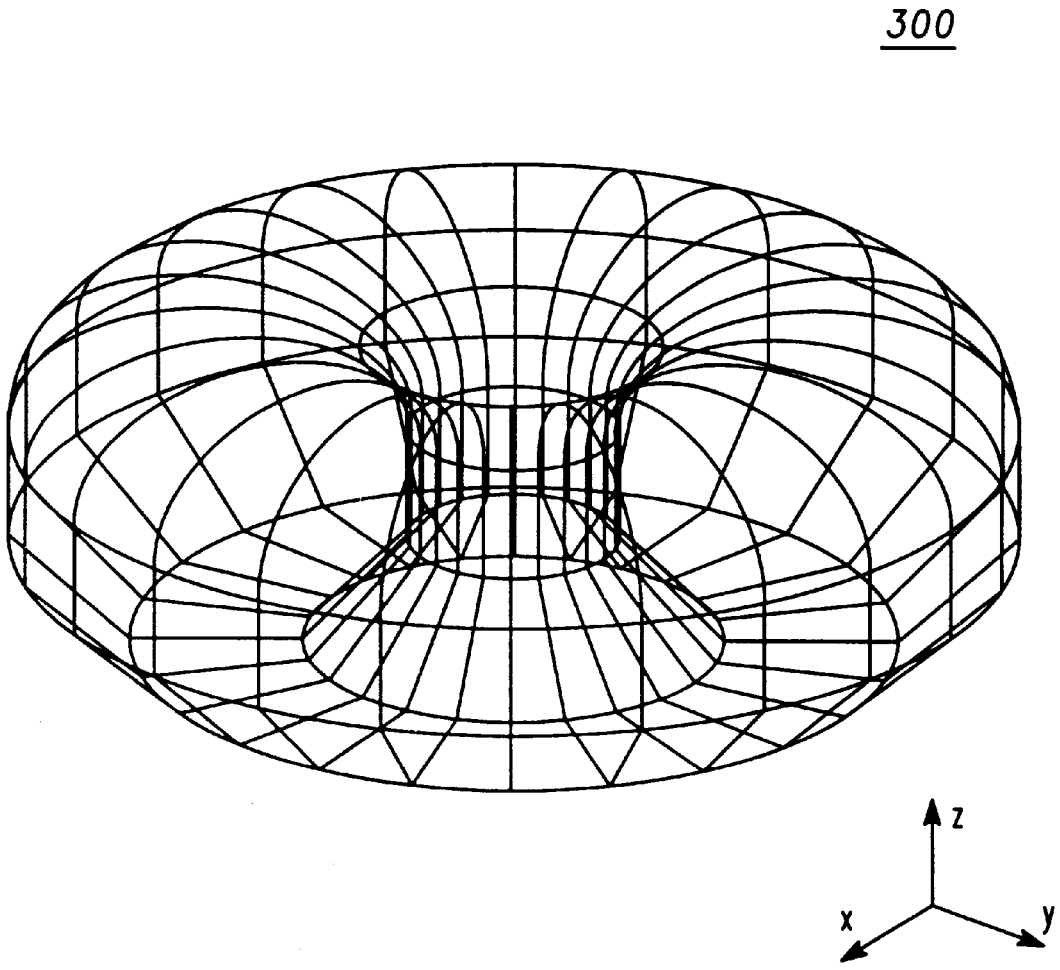
FIG. 3 shows a radiation pattern for the $E_\theta$ polarization of the first antenna shown in FIG. 2.

FIG. 3 shows a radiation pattern 300 for the $E_\theta$ polarization of the first antenna 240 shown in FIG. 2. The axes of the radiation pattern are aligned according to the axes shown in FIG. 2. At a given radius r from the phone, the magnitude of the θ component of the electric field E from the first antenna 240 is shown. The magnitude of the $E_\theta$ radiation pattern is expressed in terms of distance from the origin, i.e., the farther the pattern is from the origin, the stronger the radiation component. The $E_\theta$ radiation pattern 300 generally has a shape of a toroid oriented in the xy-plane. In other words, the $E_\theta$ pattern shows negligible $E_\theta$ radiation components along the z-axis. The radiation pattern for the $E_\phi$ polarization of the first antenna 240 shown in FIG. 2 is negligible.

Figure 4:
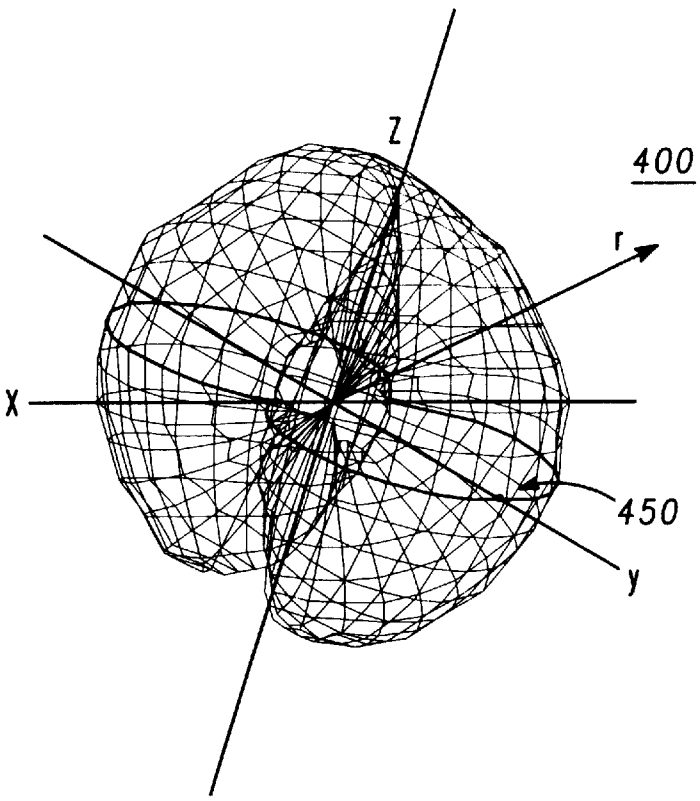
FIG. 4 shows the radiation pattern for the $E_\phi$ polarization of the second antenna shown in FIG. 2.

FIG. 4 shows the radiation pattern 400 for the $E_\phi$ polarization of the second antenna 250 shown in FIG. 2. The axes of the radiation pattern are aligned according to the axes shown in FIG. 2. At a given radius r from the phone, the magnitude of the ϕ component of the electric field E from the second antenna 250 is shown. The magnitude of the $E_\phi$ radiation pattern is expressed in terms of distance from the origin, i.e., the farther the pattern is from the origin, the stronger the radiation component. The $E_\phi$ radiation pattern 400 generally has a shape of two bulbous lobes mirrored by the xz-plane. In other words, the $E_\phi$ pattern shows negligible $E_\phi$ radiation components in the xz-plane. On the other hand, the figure-8-shaped major axis 450 of the radiation pattern 400 peaks along the y-axis. These peaks would correspond physically to the "front" or keypad side and the "back" or battery side of the radiotelephone 250 shown in FIG. 2.

Figure 5:
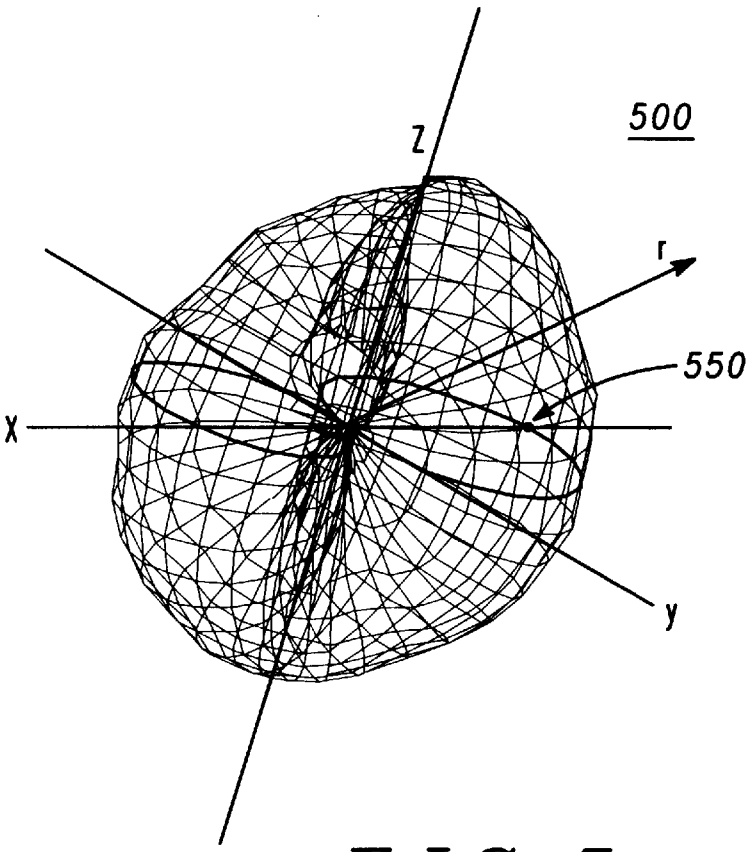
FIG. 5 shows the radiation pattern for the $E_\theta$ polarization of the second antenna shown in FIG. 2.

FIG. 5 shows the radiation pattern 500 for the $E_\theta$ polarization of the second antenna 250 shown in FIG. 2. The axes of the radiation pattern are aligned according to the axes shown in FIG. 2. At a given radius r from the phone, the magnitude of the θ component of the electric field E from the second antenna 250 is shown. The magnitude of the $E_\theta$ radiation pattern is expressed in terms of distance from the origin, i.e., the farther the pattern is from the origin, the stronger the radiation component. The $E_\theta$ radiation pattern 500 generally has a shape of two bulbous lobes mirrored by the yz-plane. In other words, the $E_\theta$ pattern shows negligible $E_\theta$ radiation components in the yz-plane. On the other hand, the figure-8-shaped major axis 550 of the pattern 500 has peaks along the x-axis. These peaks would correspond physically to the "left" side and the "right" side of the radiotelephone 250 shown in FIG. 2.

The most significant $E_\theta$ radiation that contributes to correlation occurs in the xy-plane. The first dipole antenna patterns shown in FIG. 3 are circles showing uniform magnitude and phase response. The second antenna pattern shown in FIG. 5 is figure-8-shaped with two lobes of equal size and opposite phase. The multiplication and integration of these two patterns of response result in zero covariance and therefore zero correlation. The other planes, the xz-plane and the yz-plane, show similar calculation results. Slight departures from this idealized geometry result in small components rather than the zero components described above. In a practical implementation very low, but not zero correlation, is easily achieved.

Thus, even with the first antenna 240 operating in close proximity to the second antenna 250, the two antennas 240, 250 have a low correlation. Performance tests have shown that the correlation between the two antennas 240, 250 are well below the 0.6 correlation goal.

Figure 6:
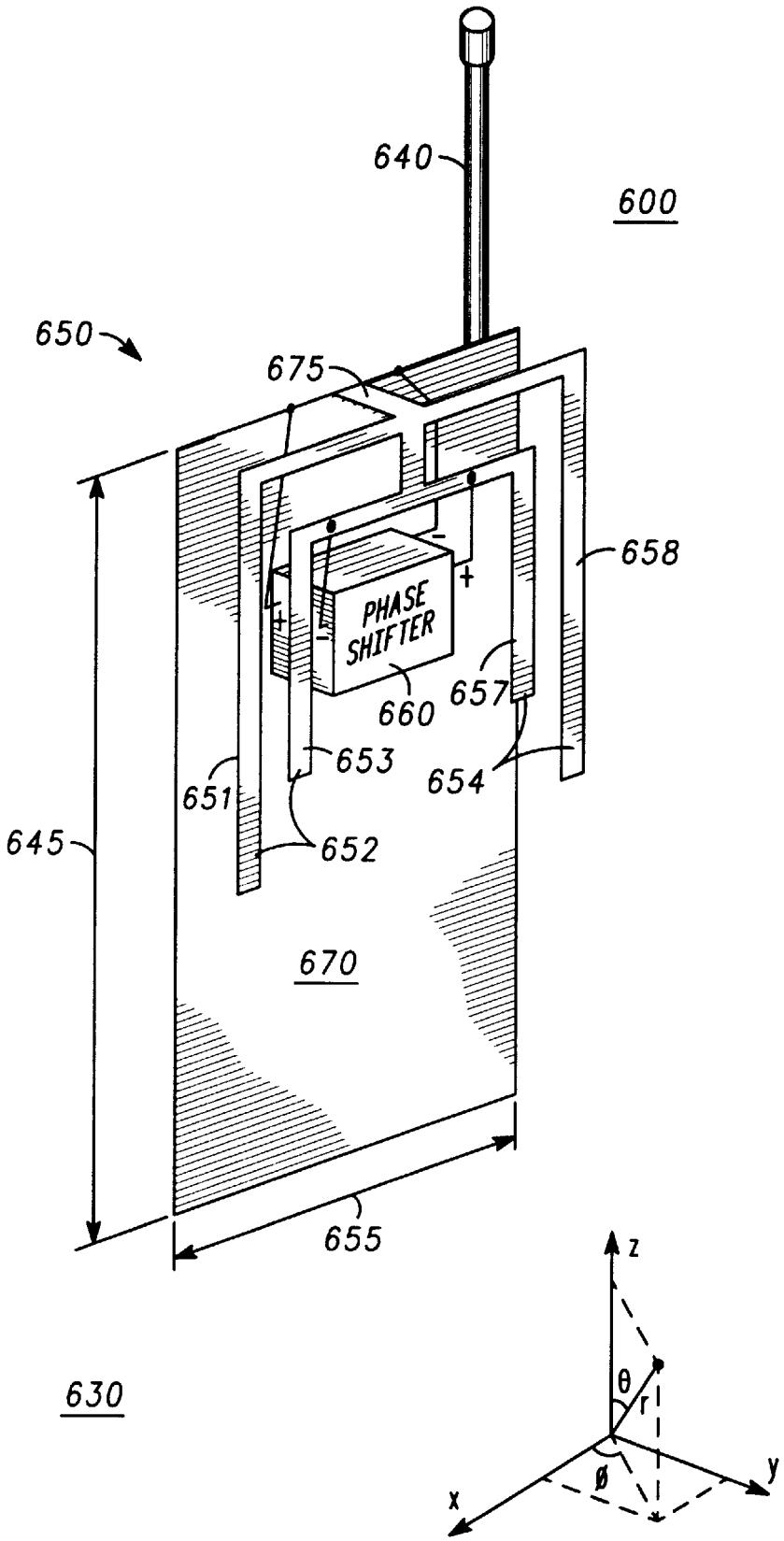
FIG. 6 shows a simplified diagram of a difference drive diversity antenna structure implemented according to a second preferred embodiment in a radiotelephone.

Other difference drive diversity antenna structures can also produce the highly decorrelated radiation patterns shown in FIGS. 3–5. FIG. 6 shows a simplified diagram of a difference drive diversity antenna structure 600 implemented according to a second preferred embodiment in a radiotelephone 630. In this embodiment F antenna structures are used in the radiators 652, 654 instead of the quarter wavelength slot antennas shown in FIG. 2. This allows operation of the difference drive diversity antenna structure 600 in more than one frequency band.

A first antenna 640, such as a retractable linear wire antenna, is aligned parallel to the major axis 645 of a radiotelephone 630. This axis will be considered the z-axis. When the first antenna 640 is fully-extended, as shown, the length of the antenna is a quarter wavelength of a frequency of interest. During operation, the first antenna 640 produces signals that are vertically polarized ($E_\theta$) with respect to the major axis, which would lie in the xy-plane.

A second antenna 650 has dual radiators 652, 654. In this embodiment, each radiator 652, 654 has a pair of inverted F-antennas 651, 653; 657, 658. One pair of inverted F antennas 651, 658 is tuned to a lower frequency band, and another pair of inverted F antennas 653, 657 is tuned to a higher frequency band. The common leg 675 of the four inverted F antennas is coupled to the circuit board 670 for grounding purposes. By slightly changing the geometry of the common leg 675, the inverted F antenna configuration can be easily replaced by a towelbar antenna configuration. For the inverted F antenna configuration, the first radiator 652 is aligned along one edge of a circuit board 670 of the radiotelephone 630 parallel to the major axis 645 and the second radiator 654 is aligned along an opposite edge of the circuit board 670. Although the radiators need not be placed at opposite edges of the circuit board 670, as the separation distance between the two radiators increases, the performance of the second antenna 650 increases.

The two radiators 652, 654 are driven 180 degrees out of phase but at the same magnitude using a single differential port for each radiator. A phase shifter 660, such as a balun or transmission line, is used to create the driving signals for each radiator 652, 654. At the frequency ranges that are common to the individual radiators 652, 654, differentially driving the two radiators 652, 654 of the second antenna 650 creates $E_\phi$ and $E_\theta$ components of the electric field vectors in the xy-plane that are decorrelated to the $E_\theta$ components of the first antenna 640 as previous described. The $E_\phi$ components of the first antenna 640 are negligible. Thus, even with the first antenna 640 operating in close proximity to the second antenna 650, the two antennas 640, 650 have a low correlation. Performance tests have shown that the correlation between the two antennas 240, 250 is well below the performance goal of 0.6.

Figure 7:
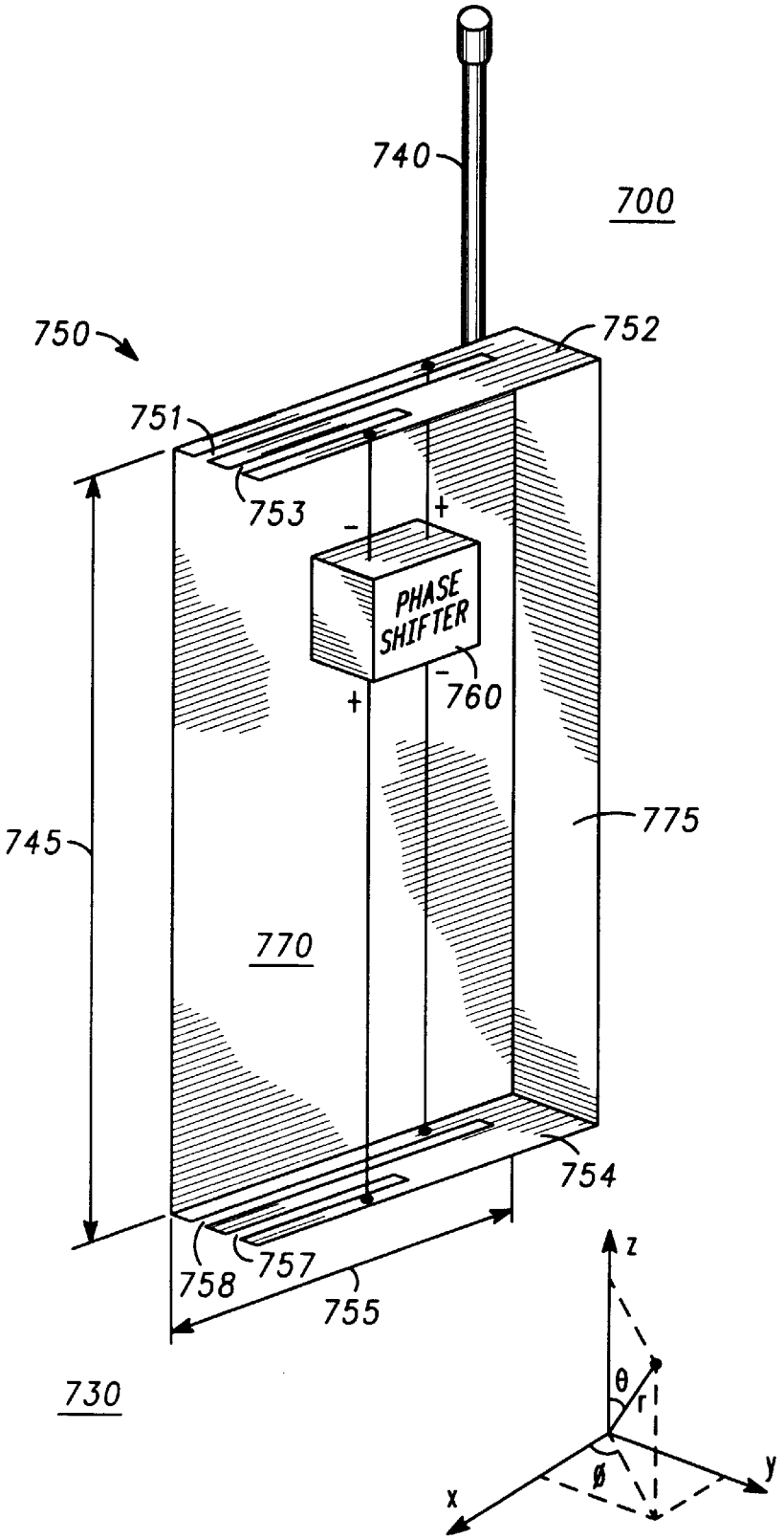
FIG. 7 shows a simplified diagram of a difference drive diversity antenna structure implemented according to a third preferred embodiment in a radiotelephone.

FIG. 7 shows a simplified diagram of a difference drive diversity antenna structure 750 implemented according to a third preferred embodiment in a radiotelephone 730. In this embodiment multi-band slot antenna structures, such as those disclosed in "Multi-Band Slot Antenna Structure and Method" by Louis J. Vannatta and Hugh K. Smith (Attorney Docket No. CE01548R), are used in radiators 752, 754 instead of the quarter wavelength slot antennas shown in FIG. 2. Like the inverted F antenna structures, this allows operation of the difference drive diversity antenna structure 700 in more than one frequency band. Also, in this embodiment, the radiators 752, 754 are aligned parallel to the minor axis of the radiotelephone 230.

A first antenna 740, such as a retractable linear wire antenna, is aligned parallel to the major axis 745 of a radiotelephone 730. This axis will be considered the z-axis. When the first antenna 740 is fully-extended, as shown, the length of the antenna is a quarter wavelength of a frequency of interest. During operation, the first antenna 740 produces signals that are vertically polarized with respect to the major axis, which would lie in the xy-plane.

A second antenna 750 has dual radiators 752, 754. In this embodiment, each radiator 752, 754 has a pair of quarter wavelength slot antennas 751, 753; 757, 758 implemented in a conductive surface. The common leg 775 of the four slot antennas is coupled to the circuit board 770 for grounding purposes. One pair of slot antennas 751, 758 is tuned to a lower frequency band, and another pair of slot antennas 753, 757 is tuned to a higher frequency band. In this embodiment, the first radiator 752 is aligned along one edge of a circuit board 770 of the radiotelephone 730 parallel to the minor axis 755 and the second radiator 754 is aligned along an opposite edge of the circuit board 770. Although the radiators need not be placed at opposite edges of the circuit board 770, as the separation distance between the two radiators increases, the performance of the second antenna 750 increases. In many cases, the increased maximum separation allowed by aligning of the radiators 752, 754 parallel to the minor axis 755 will increase the performance of the difference drive diversity antenna structure.

The two radiators 752, 754 are driven 180 degrees out of phase but at the same magnitude using a signal differential port for each radiator. A phase shifter 760, such as a balun or transmission line, is used to create the driving signals for each radiator 752, 754. At the frequency ranges that are common to the individual radiators 752, 754, differentially driving the two radiators 752, 754 of the second antenna 750 creates $E_\phi$ and $E_\theta$ components of the electric field vectors in the xy-plane that are decorrelated to the $E_\theta$ components of the first antenna 740. The $E_\phi$ components of the first antenna 740 are negligible. Thus, even with the first antenna 740 operating in close proximity to the second antenna 750, the two antennas 740, 750 have a low correlation.

Figure 8:
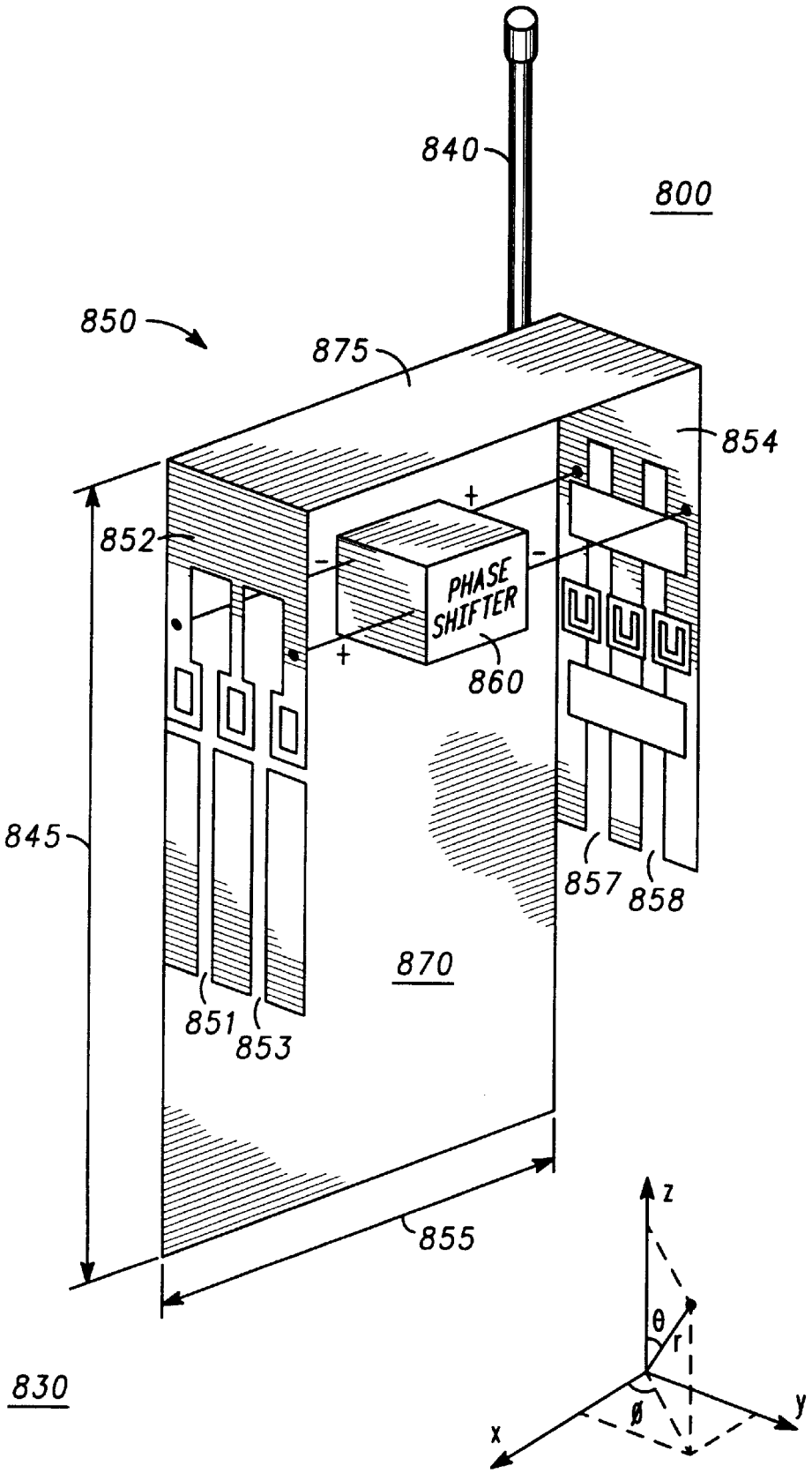
FIG. 8 shows a simplified diagram of a difference drive diversity antenna structure implemented according to a fourth preferred embodiment in a radiotelephone.

FIG. 8 shows a simplified diagram of a difference drive diversity antenna structure 800 implemented according to a fourth preferred embodiment in a radiotelephone 830. In this embodiment, multi-layered compact slot antenna structures, such as those disclosed in "Multi-Layered Compact Slot Antenna Structure and Method" by David R. Haub, Louis J. Vannatta, and Hugh K. Smith (Attorney Docket No. CE01551R), are used in radiators 852, 854 instead of the quarter wavelength slot antennas shown in FIG. 2. Many other antenna structures, such as helices, patches, loops, and dipoles, can also be used in place of the disclosed structures.

A first antenna 840, such as a retractable linear wire antenna, is aligned parallel to the major axis 845 of a radiotelephone 830. This axis will be considered the z-axis. When the first antenna 840 is fully-extended, as shown, the length of the antenna is a quarter wavelength of a frequency of interest. During operation, the first antenna 840 produces signals that are vertically polarized with respect to the major axis, which would lie in the xy-plane.

A second antenna 850 has dual radiators 852, 854. In this embodiment, each radiator 852, 854 has a pair of multi-layer compact slot antennas 851, 853; 857, 858 implemented using two conductive layers sandwiching a dielectric layer. The common leg 875 of the four slot antennas is coupled to the circuit board 870 for grounding purposes. One pair of multi-layered compact slot antennas 851, 858 is tuned to a lower frequency band, and another pair of multi-layered compact slot antennas 853, 857 is tuned to a higher frequency band. In this embodiment, the first radiator 852 is aligned along one edge of a circuit board 870 of the radio-telephone 830 parallel to the major axis 855 and the second radiator 854 is aligned along an opposite edge of the circuit board 870. Although the radiators need not be placed at opposite edges of the circuit board 870, as the separation distance between the two radiators increases, the performance of the second antenna 850 increases.

The two radiators 852, 854 are driven 180 degrees out of phase but at the same magnitude using a single differential port for each radiator. A phase shifter 860, such as a balun or transmission line, is used to create the driving signals for each radiator 852, 854. At the frequency ranges that are common to the individual radiators 852, 854, differentially driving the two radiators 852, 854 of the second antenna 850 creates $E_\phi$ and $E_\theta$ components of the electric field vectors in the xy-plane that are decorrelated to the $E_\theta$ components of the first antenna 840. The $E_\phi$ components of the first antenna 840 are negligible. Thus, even with the first antenna 840 operating in close proximity to the second antenna 850, the first antennas 840, 850 have a low correlation.

Thus the difference drive diversity antenna structure maintains high levels of decorrelation between a first antenna and a second antenna implemented in a portable wireless communication device. This allows for high antenna performance even when the two antennas are operated in close proximity to each other and a circuit board. This also reduces antenna currents on the body of the device. While specific components and functions of the difference drive diversity antenna structure are described above, fewer or additional functions could be employed by one skilled in the art within the true spirit and scope of the present invention. The invention should be limited only by the appended claims.

We claim:

1. A difference drive diversity antenna structure comprising:

a first antenna, having a radiation pattern with a first polarization;

a second antenna, proximate to the first antenna, having a first radiating element with a radiation pattern having a second polarization and a second radiating element with a radiation pattern having a third polarization; and a phase shifter, for differentially driving the first radiating element out of phase relative to the second radiating element such that a correlation between an overall polarization of a radiation pattern of the second antenna and the first polarization is less than 0.6, and a correlation between the overall polarization of the radiation pattern of the second antenna and the second polarization is less than 0.6.

2. A difference drive diversity antenna structure according to claim 1 wherein a correlation between the second polarization and the first polarization is less than 0.6

3. A difference drive diversity antenna structure according to claim 2 wherein a correlation between the third polarization and the first polarization is less than 0.6.

4. A difference drive diversity antenna structure according to claim 1 wherein a correlation between the second polarization and the first polarization is greater than 0.6.

5. A difference drive diversity antenna structure according to claim 4 wherein a correlation between the third polarization and the first polarization is greater than 0.6

6. A difference drive diversity antenna structure according to claim 1 where a correlation between the overall polarization of the radiation pattern of the second antenna and the third polarization is less than 0.6

7. A difference drive diversity antenna structure according to claim 1 wherein the phase shifter differentially drives the first radiating element 180 degrees out of phase relative to the second radiating element.

8. A difference drive diversity antenna structure according to claim 1 wherein the phase shifter differentially drives the first radiating element and the second radiating element at the same magnitude.

9. A difference drive diversity antenna structure according to claim 1 wherein the phase shifter is a balun.

10. A difference drive diversity antenna structure according to claim 1 wherein the phase shifter is a transmission line.

11. A difference drive diversity antenna structure according to claim 1 wherein the first radiating element comprises:

a slot tuned to a first frequency band.

12. A difference drive diversity antenna structure according to claim 11 wherein the second radiating element comprises:

a slot tuned to the first frequency band.

13. A difference drive diversity antenna structure according to claim 1 wherein the first radiating element comprises:

an inverted F structure having a leg and a radiator tuned to a first frequency band.

14. A difference drive diversity antenna structure according to claim 13 wherein the second radiating element comprises:

an inverted F structure having a leg and a radiator tuned to the first frequency band.

15. A difference drive diversity antenna structure according to claim 1 wherein the first radiating element comprises:

a multi-layer compact slot tuned to a first frequency band.

16. A difference drive diversity antenna structure according to claim 15 wherein the second radiating element comprises:

a multi-layer compact slot tuned to the first frequency band.

17. A radiotelephone comprising:

a first antenna, aligned parallel to a major axis of the radiotelephone, having a radiation pattern with a first polarization;

a second antenna, having a first radiating element with a radiation pattern having a second polarization and a second radiating element with a radiation pattern having a third polarization; and a phase shifter, for differentially driving the first radiating element out of phase relative to the second radiating element such that a correlation between an overall polarization of a radiation pattern of the second antenna and the first polarization is less than 0.6, and a correlation between the overall polarization of the radiation pattern of the second antenna and the second polarization is less than 0.6

18. A radiotelephone according to claim 17 wherein the first radiating element is driven 180 degrees out of phase relative to the second radiating element.

* * * * *